United States Patent [19]

Jamer

[11] 4,394,920

[45] * Jul. 26, 1983

[54] SELF LOCKING CONTAINER CLOSURE

[76] Inventor: Ernst R. Jamer, 625 Shelter Creek La. #353, San Bruno, Calif. 94066

[ * ] Notice: The portion of the term of this patent subsequent to May 25, 1999, has been disclaimed.

[21] Appl. No.: 314,282

[22] Filed: Oct. 23, 1981

Related U.S. Application Data

[63] Continuation-in-part of Ser. No. 182,552, Aug. 29, 1980, Pat. No. 4,331,248, and a continuation-in-part of Ser. No. 256,350, Apr. 21, 1981, abandoned.

[51] Int. Cl.[3] ..... B65D 41/48

[52] U.S. Cl. ..... 215/253

[58] Field of Search ..... 215/250, 253, 256

[56] References Cited

U.S. PATENT DOCUMENTS

| | | | |
|---|---|---|---|
| 3,300,073 | 1/1967 | Benz | 215/256 |
| 3,462,035 | 8/1969 | Grussen | 215/320 X |
| 4,230,229 | 10/1980 | Crisci | 215/253 |
| 4,331,248 | 5/1982 | Jamer | 215/256 |

*Primary Examiner*—Donald F. Norton

*Attorney, Agent, or Firm*—Townsend and Townsend

[57] ABSTRACT

A one-piece container closure for use with pressurized containers, such as champagne bottles. The closure includes a shank attached to a top for sealing the bottle. An expandable skirt depends from the top and surrounds a ring on the bottle neck. A plurality of retaining shoulders extend inwardly from the skirt to engage a lower surface on the neck ring. A retaining ring shaped to conform to the shape of the skirt is frangibly attached to the lower edge of the skirt to inhibit the radial expansion of the lower edge of the skirt to keep the cap on the bottle. To remove the cap, the retaining ring is first separated from the lower edge of the skirt. The retaining ring is then slid up towards the top of the cap or down off of the skirt to allow the skirt to expand radially which permits the retaining shoulders to become disengaged from under the neck ring when the cap is pulled upwardly.

20 Claims, 8 Drawing Figures

SELF LOCKING CONTAINER CLOSURE

This is a continuation-in-part application of my copending U.S. Patent Applications Ser. No. 182,552, filed Aug. 29, 1980, now U.S. Pat. No. 4,331,248 and Ser. No. 256,350 filed Apr. 21, 1981, now abandoned.

BACKGROUND OF THE INVENTION

Closures for pressurized containers have generally been multicomponent devices. For example, sparkling wines, such as champagne, sekt or spumante have often been sealed with cork closures wired onto the neck of the bottle. These natural cork closures, besides being expensive, require a number of steps for their insertion and additional steps for placing the wire retainer over the cork and around a ring on the neck of the bottle. Such a closure adds to the cost of the product sold.

One problem with closures for sparkling wines which use wire retainers is their well-known propensity to suddenly blow off the end of the bottle after the wire retainer is removed. This may tend to happen especially if the wine is not chilled sufficiently or if it is shaken or jarred; in either case the high pressure developed beneath the cork, be it natural or plastic, is sufficient to discharge the cork from the bottle at quite high velocities. Damage to persons and property often results from the sudden, unexpected discharge of the cork.

In U.S. Pat. No. 3,946,891 to Picoy, et al., a flexible plastic cap for use on pressurized containers which eliminates the wire retainer is disclosed. The cap in Picoy includes an inner shank, an outer cap and a depending skirt portion having internal rib portions for engagement under the ring on the neck of the bottle. However in Picoy the cap relies upon circumferential expansion of the skirt material to permit the rib portion to pass over the outwardly extending ring or band on the bottle. Thus, the thickness of the ring around the neck of the bottle and the thickness of the rib portion on the skirt are limited by the resilient character of the material from which the cap is made. If the circumferential stretching is too great, the skirt may be permanently deformed so that the rib portion does not fully engage the lower surface of the rim of the bottle. If the ring and/or ribs are not thick enough, the cap may blow off the bottle. Further, even if the plastic material from which the cap is made would tend to return to its fully unstressed state, because of the time lag involved the cork may be blown off the end of the bottle before such contraction has been completed.

The following U.S. Pat. Nos. may also be of interest: 4,162,736; 4,057,160; 4,033,472 and 3,809,370.

SUMMARY OF THE INVENTION

A one-piece container closure finding special utility when used with containers holding pressurized fluids is disclosed. The closure, or cap, includes generally a shank and a top attached to the upper end of the shank. The shank is sized to fit within the neck of the container, typically a bottle adapted for holding sparkling wines, such as champagne. The combination of the top and the shank is of conventional design and acts to seal the interior of the bottle.

A skirt portion depends from the lower outer edge of the top of the cap and surrounds the upper portion of the neck of the bottle. The bottle has a neck ring located below the rim of the bottle. Along the lower edge of the skirt are a plurality of retaining shoulders each having a generally horizontal upper surface for engaging a lower surface on the ring of the bottle.

The retaining shoulders have an upwardly and inwardly tapered inclined surface so that when the cap is placed over the neck of the bottle, the inclined surfaces ride against the neck ring on the bottle. A removable retainer is attached along the lower edge of the skirt to inhibit the radial expansion of the lower edge of the skirt; the lower portion of the retaining shoulders are likewise inhibited from radial expansion by the retainer.

As the retaining shoulders of the cap are forced over the neck ring, the upper portions of the shoulders pivot radially outwardly. This outward pivotal movement can be provided for in several ways. In one embodiment, the skirt has a number of resilient, expandable pleated sections. In another embodiment the expandable skirt has a smooth cylindrical or slightly conical surface with vertical slits in the skirt between the retaining shoulders to enable the resilient skirt to expand radially when the shoulders are forced over neck ring.

After the upper, ring engaging surfaces of the retaining shoulders have cleared the neck ring, the resilient skirt and retainer pivot the shoulders back to their normal, generally horizontal attitude so that the ring engaging surfaces of the retaining shoulders engage the lower surface of the neck ring.

The removable retainer can be a simple tear strip attached at points along the lower edge of the skirt. However, it has been found that a retainer in the form of a ring having an inner circumference shaped to conform to the outer surface of the skirt is generally preferred over a tear strip type of retainer. The inner surface of the conforming retaining ring helps to keep the pleated sections of a pleated skirt from flattening out against the retaining ring, which can occur at high bottle pressures when using a tear strip retainer. When a skirt having a smooth surface is used, the inner surface of the retaining ring would likewise conform to the shape of the skirt to prevent the lower edges of the skirt sections from expanding outwardly.

To remove a cap having a tear strip type of retainer from a bottle, the tear strip is torn away from the lower edge of the skirt. This allows the entire skirt to expand radially and permit the retaining shoulders to disengage from under the ring on the bottle. However, if the pressure in the bottle is great enough the cap may be blown off the top of the bottle upon removal of the tear strip retaining ring.

To remove a cap having a retaining ring type of retainer, the ring is first pushed up a short distance towards the top of the cap at several places around the retaining ring. This breaks the attachment between the retaining ring and the lower edge of the skirt. However, since the retaining ring still surrounds the lower portion of the skirt, the skirt cannot expand to insure the cap remains on the bottle. The retaining ring is then grasped by the user and slid up towards the top of the cap. When used with a pleated skirt, the sawtooth-shaped conforming inner surface of the ring cannot slide over the top of the cap so that the retaining ring provides a convenient structure for urging the cap off the bottle. The outer circumferential surface of the retaining ring can be grooved to help the user to twist the cap, through the interface of the conforming inner surface of the retaining ring and the pleated skirt, when removing the cap.

Alternatively, after breaking the seal the retaining ring may be slid down away from the skirt and onto the neck of the bottle; the user then can grasp the cap and pull the cap from the bottle with a twisting movement. The use of the retaining ring therefore allows the cap to be removed in a controlled manner with less effort by the user. Further, one can reseal the bottle by replacing the cap on the bottle and sliding the conforming retaining ring over the skirt to surround the retaining shoulders.

The closure of the invention can be molded as a single, unitary piece; the price of the closure can therefore be low. The corking or capping machines used with the cap can be simple because it is mounted on the container with a single linear movement.

A significant feature of this invention lies in the provision of a resilient, expandable skirt. The pivotal movement of the shoulder as it pivots outwardly when the cap is inserted over the neck of a container is not limited by the elasticity of the material. The pleated, split or otherwise expandable skirt allows the shoulders to pivot as they ride over the ring on the neck of the bottle. Thus the ring on the neck can be thicker and the upper ring engaging surfaces of the retaining shoulders can be much deeper without causing the elastic limit of the skirt material to be exceeded. Because the neck ring-shoulder engaging surface can be much deeper, the cap can be secured to the container with the ability to withstand much higher internal pressures within the container.

The conforming retaining ring, as well as the resilient skirt, provide an extra degree of safety compared with closures using wire retainers. After the retaining ring is separated from its attachment to the skirt, the retaining ring, the resilient skirt and the shoulders continue to keep the cap secured to the container. Only when the cap is grasped by the user, the conforming retaining ring pushed up or down away from the lower edge of the skirt and the cap is urged upwardly, typically accompanied by a twisting action, will the retaining forces of the shoulders be overcome to allow the cap to be removed.

The tear strip type of retaining ring provides a dual function. It secures the lower edge of the skirt against radial expansion to keep the cap on the container. It also insures against tampering with the contents of the container for the only way to remove the cap is to first remove the tear strip. After removal of the tear strip, tampering is obvious.

In addition to the above functions, retaining rings used with pleated skirts keep the pleated sections from flattening out or otherwise deforming when very high bottle pressures are present and provide a convenient structure for applying axial and rotary force to the cap to remove it from the bottle. Retaining rings, whether the skirt is pleated or not, also allow the cap to be used to reseal the bottle and insure that the cap does not inadvertently blow off the top of the bottle when the seal between the retaining ring and skirt is broken.

Additional features and advantages of the invention will appear from the following description in which the preferred embodiment has been set forth in detail in conjunction with the accompanying drawings.

DETAILED DESCRIPTION OF THE PREFERRED EMBODIMENTS

Figure 1:
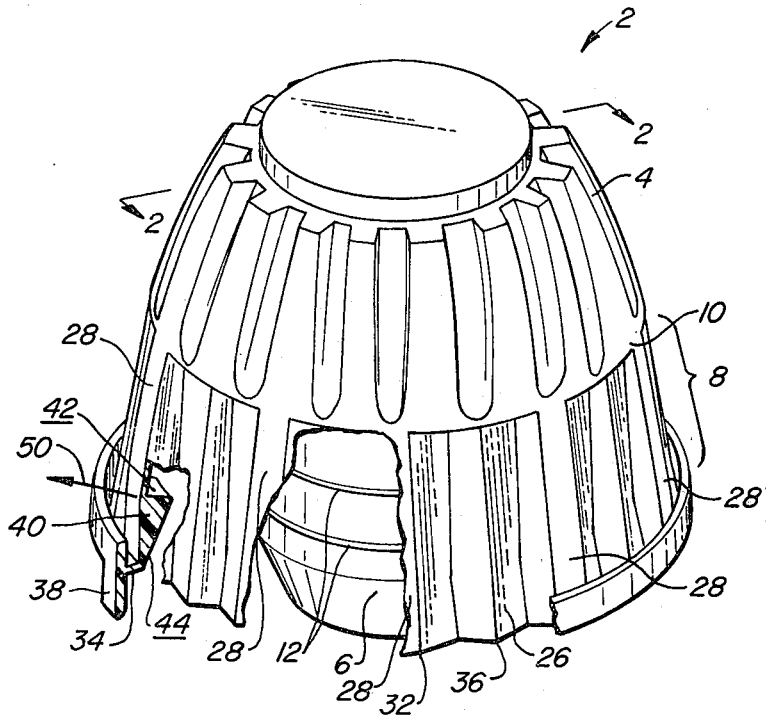
FIG. 1 is an isometric view of one embodiment of the cap of the invention partially broken away to show a retaining shoulder.
Figure 2:
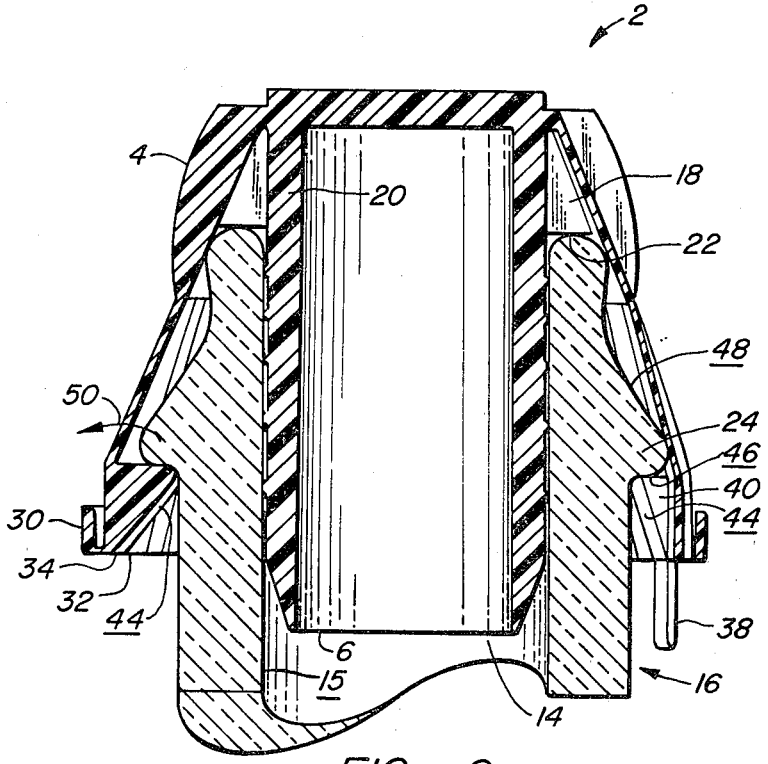
FIG. 2 is a cross-sectional view of the cap of FIG. 1 mounted to the neck of a bottle.

Turning now to FIGS. 1 and 2, a first preferred embodiment of a cap 2 of the invention will be described. Generally cap 2 includes a top 4, a shank 6 extending centrally from the top and a pleated skirt 8 attached to and depending from the lower outer edge 10 of the top.

Although the preferred embodiments will be described in terms of caps particularly adapted for use with a bottle containing sparkling wine, a cap of the present invention can also be used for sealing other types of containers of the type having a ring around the neck of the container.

The top and shank of the cap are of conventional design. The shank includes a number of sealing ridges 12. When the shank is forced within the bore 14 of the neck 16 of the bottle, the sealing ridges are pressed tightly against the interior surface 15 of the bore to insure a tight seal. A number of webs 18, shown in FIG. 2, are formed between the top 4 and the upper portion 20 of the shank. When the cap is fully seated over the neck of the bottle, the webs contact the rim 22 of the bottle.

The neck of the bottle has a ring 24 located on its outer surface below rim 22.

The pleated skirt has a number of alternating, generally vertically disposed, pleated segments 26 and locking segments 28. The locking segments are generally planar members extending from outer edge 10. The pleated segments are arranged between each locking segment and likewise depend from the lower outer edge of the top. A tear strip retainer 30 is connected to the lower edge 32 of locking segments 28 by a relatively thin connecting segment 34. A handle portion 38 of the tear strip ring is provided so that the tear strip ring can be grasped by the user and torn away from the lower edge of the skirt.

A retaining shoulder 40 extends inwardly from near the lower edge of each of the locking segments of the skirt. The retaining shoulders have a triangular cross-sectional shape and include a generally horizontal upper ring engaging surface 42 (see FIG. 1) and an upwardly and inwardly sloping ring biasing surface 44 (see FIG. 2). When the cap is fully inserted over the neck of a bottle, the upper ring engaging surface lies juxtaposed to the generally horizontal lower surface 46 of ring 24 on the neck of the bottle.

The W-shaped cross-sectional outline of pleated segments 26 is shallowest near outer edge 10, is deepest near the ring engaging surface 42 and then narrows somewhat at their lower edges 36. This variation promotes greater flexibility when capping the bottle while somewhat inhibiting radial expansion of the skirt along edges 32, 36 after the tear strip is removed. Therefore, the cap will not be as susceptible to inadvertently blowing off the bottle after the tear strip is removed, a significant safety feature.

To cap the bottle the user simply forces shank 6 of the cap within the bore of the bottle and presses on the top of the cap until surface 42 of retaining shoulders 40 engage lower surface 46 of ring 24. As the shoulders pass over the ring, the tear strip keeps the lower edges of the skirt from radially expanding. The force exerted by the upper surface 48 of ring 24 against ring bias surface 44 of retaining shoulder 40 causes the retaining shoulders to pivot in the direction indicated by arrow 50. This outward pivotal movement is made possible by the expansion of the skirt along the pleated segments.

To remove cap 2 the user first grips the handle portion of the tear strip and tears the tear strip away from the lower edge of the skirt. The user then grasps the top and pulls upwardly, typically with a simultaneous twisting action. The unrestrained pleated skirt allows the shoulders to expand radially and become disengaged from the ring. Depending upon various factors such as the materials chosen for the cap, the size of the ring on the neck of the bottle and the pressures within the bottle, a greater or fewer number of pleated segments and retaining shoulders can be used. Also other types of radially expandable skirts can be used in lieu of the pleated skirt.

Turning now to FIGS. 3–6, a second embodiment of the cap of the invention will be described. The primary difference between cap 60 of FIGS. 3 and 4 and cap 2 of FIGS. 1 and 2 is the use of a conforming retaining ring 62 in lieu of the tear strip retainer 30 used with cap 2. Conforming retaining ring 62 has a grooved or otherwise roughened outer surface 64 and an inner surface 66 generally conforming to the shape of pleated skirt 68. Ring 62 is attached to the lower portion of skirt 68 at alternate points 70. Retaining shoulders 72 extend inwardly from points 70 on skirt 68. Shoulders 72 therefore extend inwardly from alternately pleated segments so that locking segments 28 of cap 2 are not required.

The insertion of cap 60 onto a bottle occurs in substantially the same manner as with cap 2. However, to remove cap 60 the user typically grasps the bottle beneath cap 60 and breaks the seal at points 70 between ring 62 and skirt 68 typically by pushing up on ring 62 with his or her thumb. Conforming retaining ring 62, after the attachment between ring 62 and skirt 68 has been severed, still circumscribes the lower portion 80 of skirt 68. Thus the skirt cannot inadvertently expand outwardly to discharge the cap unexpectedly. Next, the user grasps the cap and urges ring 62 up against a lower outer edge 74 of the top 76 of cap 60. Because of the sawtooth or W-shaped configuration of surface 66, axial movement of ring 62 is stopped by outer edge 74 with a result that axial force exerted on ring 62 tends to force cap 60 off the bottle. If desired, edge 74 can be flared outwardly a small amount, for example 0.05 centimeter, to insure that ring 62 does not slip over top 76 of cap 60. Outer surface 64 is grooved so a rotary twisting force can be transmitted by the user to cap 60 in removing the cap.

With ring 62 adjacent lower outer edge 74 of cap 76, pleated skirt 68 can expand radially allowing shoulder 72 to become disengaged from the neck ring on the bottle. To help the pleated skirt expand freely, edges 78 of skirt 68 are made quite thin so that when the skirt expands the skirt splits along edges 78 for ease of removal of cap 60. If desired edges 78 can be slit so the skirt is in effect made of a number of separate depending locking segments. This may be required when the neck ring on the bottle is large requiring a large amount of radial expansion by the skirt. The user can reinsert cap 60 back onto the bottle and slide conforming retaining ring 62 around lower portion 80 of pleated skirt 68 to generally surround shoulder 72 to secure cap 60 back onto the bottle.

Figure 7:
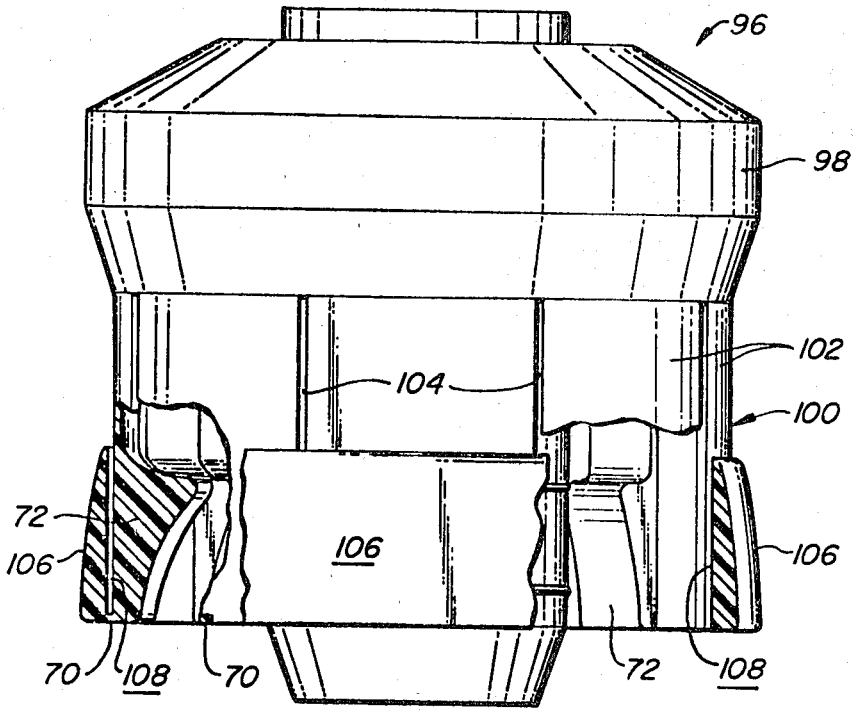
FIG. 7 is a side view of a third embodiment of the invention with portions broken away for clarity.
Figure 8:
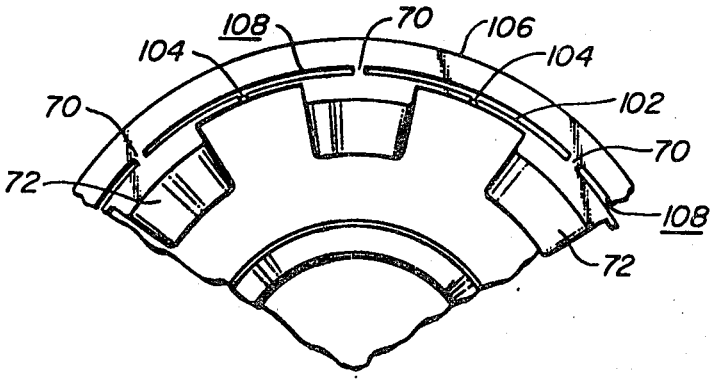
FIG. 8 is a partial bottom view of the cap of FIG. 7.

A third embodiment of the cap 96 of the invention is shown at FIG. 7. In this embodiment the cap is similar to that shown in FIGS. 3–6 except the skirt 100 is generally cylindrical and is made of a number of depending locking segments 102 separated by gaps 104. The conforming retaining ring 106 has a cylindrical inner surface 108 to conform to the shape of skirt 100. The top 98 is slightly enlarged to aid in grasping cap 96 during removal.

Figure 3:
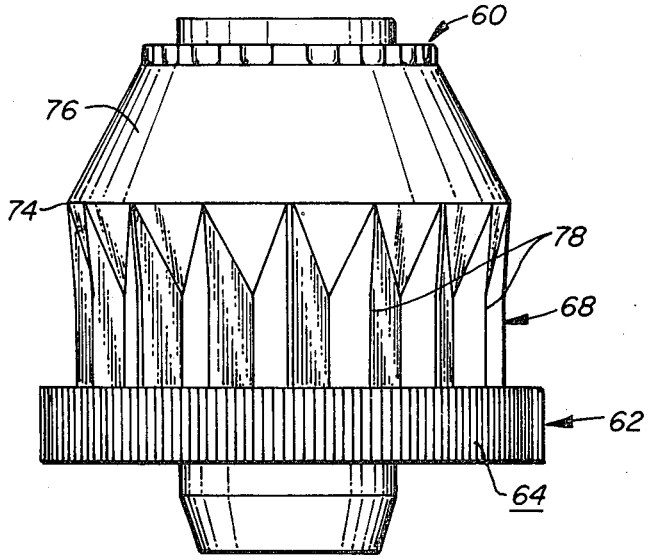
FIG. 3 is a side view of another embodiment of the cap of the invention.
Figure 4:
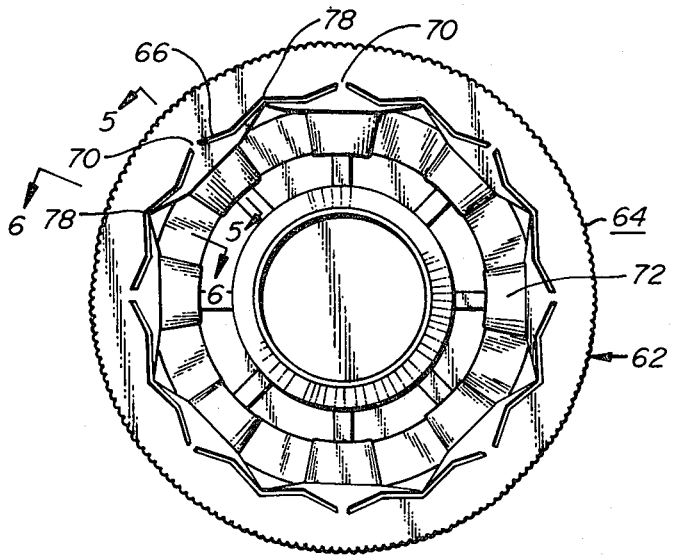
FIG. 4 is a bottom view of the cap of FIG. 3 illustrating the placement and attachment of the conforming retaining ring.
Figure 5:
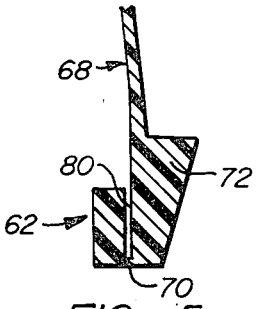
FIGS. 5 and 6 are partial sectional views taken along lines 5—5 and 6—6 of FIG. 4.
Figure 6:
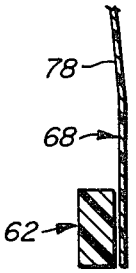

The use and operation of cap 96 is similar to that of cap 60 of FIG. 3. After breaking connecting points 70, the user may slip ring 106 down onto the neck of the bottle, grasp top 98 and remove cap 96 with a twisting motion. It has been found that removal of the retaining ring down onto the bottle neck when using either cap 60 or cap 92 may be desired when it would otherwise inhibit the proper radial expansion of the skirt.

The invention can also be used with containers which are not pressurized, although other methods for sealing the bore of the container may be necessary. When used with low-pressure or non-pressurized containers, the shank may be shortened or eliminated. When sealing sparkling wine, a cork insert may be used in addition to, or in lieu of, the shank so that the wine may pick up its subtle nuances during aging. Other modification and variation may be made to the disclosed embodiments without departing from what is regarded as the invention.

What is claimed is:

1. A container closure for use on a container of the type having a hollow neck, a rim at the end of the neck, the rim circumscribing the mouth of the container, and a ring extending around the neck, the closure comprising:

a top portion adapted to seat against said rim to seal said container;

a radially expandable skirt depending from said top portion to surround a portion of said neck, said skirt having an upper edge attached to said top portion and a lower edge opposite said top edge, said lower edge extending past said ring;

said skirt having a plurality of inwardly directed shoulder portions, said shoulder portions having means for rotationally biasing said shoulder portions away from the ring as said shoulder portions pass the ring on the container, said shoulder portions also including a ring engagement surface adapted for engagement under said ring to secure said closure on said container; and a retaining ring frangibly attached to said skirt below said ring engagement surface to restrict the radial movement of said shoulder portions.

2. The closure of claim 1 wherein said retaining ring has an inner surface shaped to generally conform to an adjacent outer surface of said skirt.

3. The closure of claim 1 wherein said skirt includes a plurality of depending locking segments from which said shoulder portions extend.

4. The closure of claim 3 wherein said locking segments are separated by gaps.

5. The closure of claim 1 wherein said retaining ring is attached to said lower edge of said skirt.

6. The closure of claim 1 wherein said rotational biasing means includes an upwardly and inwardly angled shoulder biasing surface so that as said shoulder portions are urged past the ring on the neck of the container, the shoulder portions being pivoted outwardly under the partial restraint of said expandable skirt and pivoted inwardly after said shoulder portions have cleared the ring.

7. The closure of claim 1 wherein said ring engagement surfaces are generally horizontal.

8. The closure of claim 1 wherein said skirt includes a plurality of radially expandable pleated segments.

9. The closure of claim 1 wherein said skirt is generally cylindrical.

10. An improved bottle closure, particularly suited for sealing pressurized bottles, said bottle having a ring around the upper portion of the neck of the bottle, said closure including a top portion adapted to seat against the rim of the bottle and seal said bottle, a skirt extending from said top portion to surround the upper portion of the neck of the bottle, means for engaging a lower surface of the ring, the improvement comprising:

said skirt is radially expandable so that said ring surface engaging means moves outwardly as said engaging means are forced past the ring on the neck of the bottle during insertion of said closure on said bottle;

a retaining ring frangibly attached to said skirt below said lower ring surface engaging means to allow the complete severance of said ring from said skirt and to limit the radial movement of said lower ring surface engaging means so that said closure is retained on said bottle; and means for transmitting rotary force from said ring to said skirt after said ring is frangibly detached from said skirt and moved toward the top portion.

11. The bottle closure of claim 10 wherein said expandable skirt includes a plurality of separated clocking segments.

12. The bottle closure of claim 11 wherein said retaining ring has a roughened outer circumferential surface.

13. The bottle closure of claim 10 wherein said rotary force transmitting means further comprises:

said skirt includes a plurality of radially expandable pleated segments; and said ring has an inner circumferential surface at least a portion of which generally conforms to the contour of said pleated skirt.

14. An article of manufacture comprising:

a hollow container having a hollow neck bounded at its mouth by a rim, said neck having a ring on the external surface thereof and located below the rim; and closure means for sealing said container mouth and comprising a retaining portion, said retaining portion including:

an expandable skirt depending from said sealing means to surround said ring on said neck and having a plurality of locking segments, each of said locking segments having an inside surface and an outside surface;

a plurality of inwardly projecting shoulder portions extending from the inside surface of said locking segments and adapted to engage a lower surface of said ring;

a retaining ring completely frangibly attached to said skirt generally below said shoulder portions to restrain radial movement of said shoulder portions and to permit the complete severance of said ring from said skirt, said retaining ring including an inner circumferential surface surrounding a portion of said skirt;

said skirt and said ring being configured to allow said ring to be detached from said skirt and moved along said skirt toward said top portion; and means for preventing movement of said ring past said top portion thereby enabling a user to apply removal force through said ring to said top portion.

15. The article of manufacture of claim 14 wherein said container is a bottle adapted to hold liquid under pressure.

16. The article of manufacture of claim 14 wherein said sealing means includes a shank sized to fit within said hollow neck.

17. A container closure for use on a container of the type having a hollow neck, a rim at the end of the neck, the rim circumscribing the mouth of the container, and a ring extending around the neck, the closure comprising:

a top portion adapted to seat against said rim to seal said container;

a radially expandable skirt depending from said top portion to surround a portion of said neck, said skirt having an upper edge attached to said top portion and a lower edge opposite said top edge, said lower edge extending past said ring;

said skirt having a plurality of inwardly directed shoulder portions, said shoulder portions having means for rotationally biasing said shoulder portions away from the ring as said shoulder portions pass the ring on the container, said shoulder portions also including a ring engagement surface adapted for engagement under said ring to secure said closure on said container;

a retaining ring;

means for completely frangibly attaching said retaining ring to said skirt below said ring engagement surface to restrict the radial movement of said shoulder portions and to allow the complete severance of said ring from said skirt;

said skirt and said ring being configured to allow said ring to be detached from said skirt and moved along said skirt toward said top portion; and means for preventing movement of said ring past said top portion thereby enabling a user to apply removal force through said ring to said top portion.

18. The closure of claim 17 further comprising means for transmitting rotary force from said ring to the balance of said closure after said ring is completely frangibly deteached from said skirt.

19. The closure of claim 18 wherein said rotary force transmitting includes portions of said ring and skirt having equal radial dimensions at the same axial position.

20. The closure of claim 17 wherein said movement preventing means includes portions of said ring and top portion having equal radial dimensions at the same rotary position.

* * * * *